United States Patent [19]

Wittel

[11] 3,981,221

[45] Sept. 21, 1976

[54] PORTABLE KEYBOARD

[76] Inventor: Luther A. Wittel, 512 Harwood Ave., Baltimore, Md. 21212

[22] Filed: Sept. 2, 1975

[21] Appl. No.: 609,534

[52] U.S. Cl. ..... 84/423; 84/404; 84/435

[51] Int. Cl.[2] ..... G10C 3/12

[58] Field of Search ..... 84/423, 404, 435, 365, 84/102

[56] References Cited

UNITED STATES PATENTS

| | | | |
|---|---|---|---|
| 1,775,330 | 9/1930 | Stoehr | 84/423 |
| 2,159,491 | 5/1939 | Rose | 84/404 |
| 2,565,239 | 8/1951 | Kostka | 84/435 |
| 2,837,004 | 6/1958 | Volpe | 84/404 |
| 3,028,780 | 4/1962 | Merchant | 84/404 |
| 3,146,658 | 9/1964 | Mandy et al. | 84/423 |
| 3,479,918 | 11/1969 | Genin | 84/404 |

*Primary Examiner*—Stephen J. Tomsky
*Attorney, Agent, or Firm*—J. Wesley Everett

[57] ABSTRACT

The assembly consists of a piano type musical keyboard which includes a plurality of elongated individual pivotally mounted key bars having a key or a representative thereof positioned on one end of each of the key bars and means associated with the opposite end of each of the bars for operating a pivotally supported hammer adapted to strike a sound producing element of a tone indicated by the keys positioned on the keyboard, the key bars being of two lengths, the key bars representing the white keys being longer than the key bars representing the black keys, the pivot means about which the key bars carrying the white key are pivoted being positioned at a greater distance from the opposite end of the key bars than the pivot means for the key bars carrying the black keys.

5 Claims, 8 Drawing Figures

PORTABLE KEYBOARD

The present invention relates to a small portable piano type musical instrument to be primarily used for instruction purposes. The instrument is shown with two octaves but may contain more if desirable. The instrument is also provided with sound producing elements wherein when a particular key is depressed the proper sound for that key will be produced; however, most of the instruments of this type being used together for instruction purposes are dummies, that is, the keys are operatable but the instrument does not produce any sound. This is primarily due to the present additional cost of the mechanism that is usually necessary in the manufacturing of these sound producing instruments, which may now be produced at a nominal cost by using a structure similar to the one shown and described herein.

One object of the invention is to provide a musical instrument for aiding and teaching of music that is simple in construction and may be easily transported in a suitable carrying case to various locations where instructions are given.

Another object of the invention is it is rugged in construction and economical to produce.

A further object of the invention is that with the the sound the instrument has more the resemblance of a regular piano, wherein the student will have an added incentive in learning to play.

While several objects of the invention have been set forth, other objects, uses and advantages will become more apparent from the following detailed description with reference to the accompanying drawings, in which.

Figure 4:
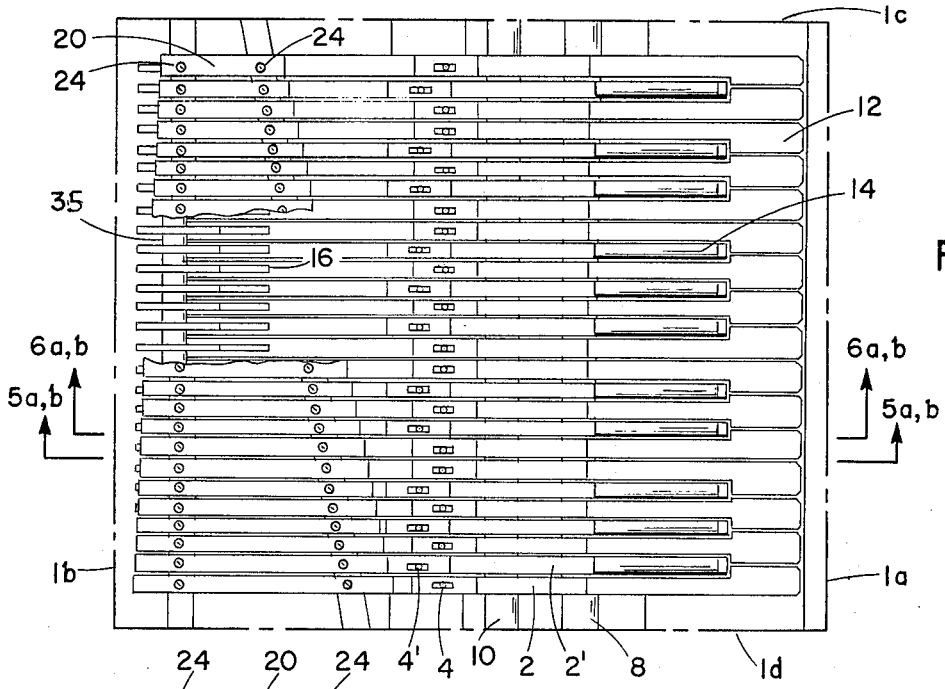
FIG. 4 is a top plan view of the instrument.
Figure 5A:
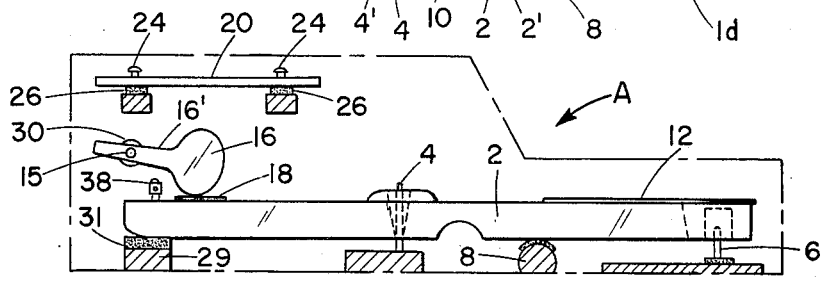

FIG. 5*a* is a sectional view taken on line 5*a*—5*a* of FIG. 4, showing a typical white key bar in rest position.

Figure 5B:
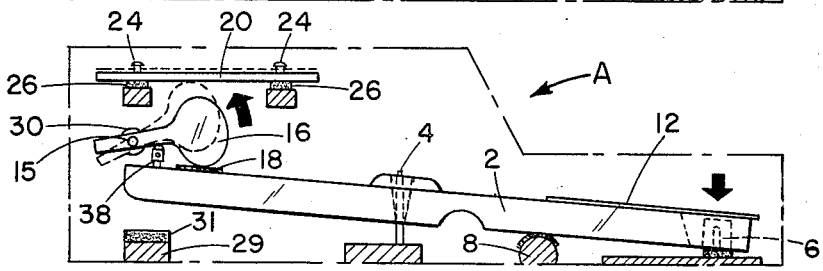

FIG. 5*b* is a sectional view taken on line 5*b*—5*b* showing a white key bar in depressed position.

Figure 6A:
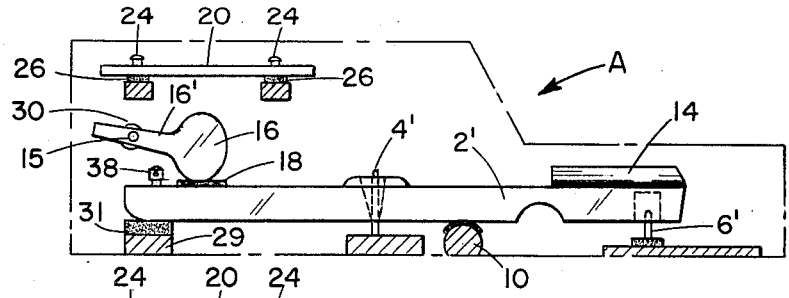

FIG. 6*a* is a sectional view taken on line 6*a*—6*a* showing a typical black key bar at rest position.

Figure 6B:
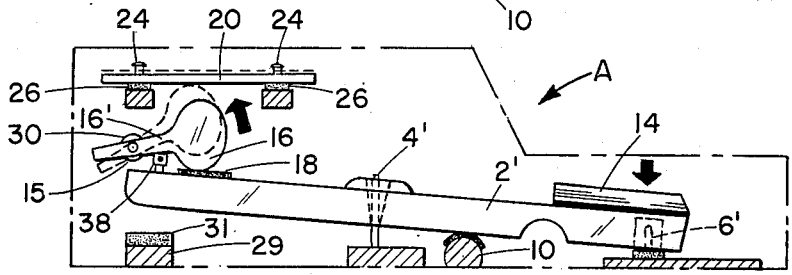

FIG. 6*b* is a sectional view taken along line 6*b*—6*b* showing the black key bar in depressed position.

In referring to the drawings, like character references are used to indicate like and similar parts throughout the several views.

The instrument A comprises a frame having a front portion 1*a*, a back portion 1*b* and two side portions 1*c* and 1*d*.

Within the frame and extending parallel with the sides thereof are a plurality of key bar members 2 and 2′. The bar members extend substantially the full depth of the frame from front to rear. The bar members 2 and 2′ are supported upon pins 4, 4′, 6 and 6′, to keep the bar members in operating position perpendicular with the plane of the keyboard.

The key bars are also mounted to pivot about the members 8 and 10, that is, the bars 2 are mounted to pivot about the member 8 and the bars 2′ are mounted to pivot about the member 10.

Positioned on the upper face of the bars 2, adjacent the front of the frame, are keys or representatives of white keys 12 and on the upper face of the members 2′ adjacent the front of the frame are placed keys or representatives of black keys 14. These keys or representatives thereof may take several forms, that is, they may be separate pieces of material secured to the upper surfaces of the bar members or they may be painted directly on the key bars to designate the color of the key or the key may be the member itself without color.

Positioned adjacent the opposite end of the bars 2 and 2′ is a stationary member 15 with spacers 35 upon which there is pivotably mounted a plurality of hammers 16.

The bar members 2 are designated as the white keys and are longer than the bars 2′ designated as the black keys and are pivoted upon the member 8 and the shorter key bars 2′ are designated as the black keys and are pivoted upon the member 10.

The pivoted mounted hammers 16 are positioned adjacent the opposite ends of the key bars 2 and 2′ and normally rest on a pad 18 positioned on the opposite end of the key bars 2 and 2′. These hammers are mounted to strike against the sound producing element 20 which is of a pitch indicated by the keys on the key board.

The white key bar members 2 are longer than the black key bar members 2′, therefore, the fulcrum 8 must be further from the opposite end of the members 2 than the fulcrum 10 supporting the black key bars in order that the opposite ends of both sets of key bars will move exactly the same distance when the respective keys are depressed.

The pivot members 8 and 10 preferably extend from one side of the frame to the other and are made from a single piece of material. The sound producing elements 20 are mounted in any suitable manner and are shown positioned on pins 24 and resting upon a soft material 26, such as felt.

The hammers 16 are operated by an adjustable pin 38 mounted on the opposite ends of both the white and black key bars as best shown in FIG. 5*b*. These pins are adapted to contact the stem portion 16′ of the hammer between the hammer per se and the hammer supporting rod 15. The pin 38 contacts the hammer stem 16′ adjacent the fulcrum 30 which will cause the hammer to be moved upwardly at substantially high speed to engage the sound producing element 20. The pin 38 is only in contact with the stem 16′ for part of the travel of the hammer. The inertia given the hammer by the pin 38 will cause the hammer to continue to travel to contact the sound producing element 20 and drop back to a position below the sound producing element 20 and out of contact with the stem 16′ as shown in full lines in FIG. 5*b* to allow the sound producing element 20 freedom to vibrate.

The opposite ends of the key bars are all at the same level and are regulated by the stop members 29 having a pad 31 of a suitable cushioned material mounted thereon for receiving the opposite end of the key bar when the key bar is at rest.

As stated before, the bars 2 on which the white keys are mounted are pivoted on the member 8 as shown in FIGS. 5*a* and 5*b* and the key bars 2′ on which the black keys are mounted are pivoted on the member 10 as shown in FIGS. 6*a* and 6*b*. This difference in the two pivot points for the white and black key bars allows the opposite ends of the key bars to move upwardly exactly the same distance when the respective black and white keys are depressed.

Encasing the instrument is a cover 32 having a fixed top portion 32' and a partially hinged top portion 32'' covering the keys per se. The portion 32'' is hinged to the portion 32' by hinges 39 and 40 which also includes a front end portion 32''' which is hinged to the outer front edge of the top portion 32'' by the hinges 42 and 44.

Figure 1:
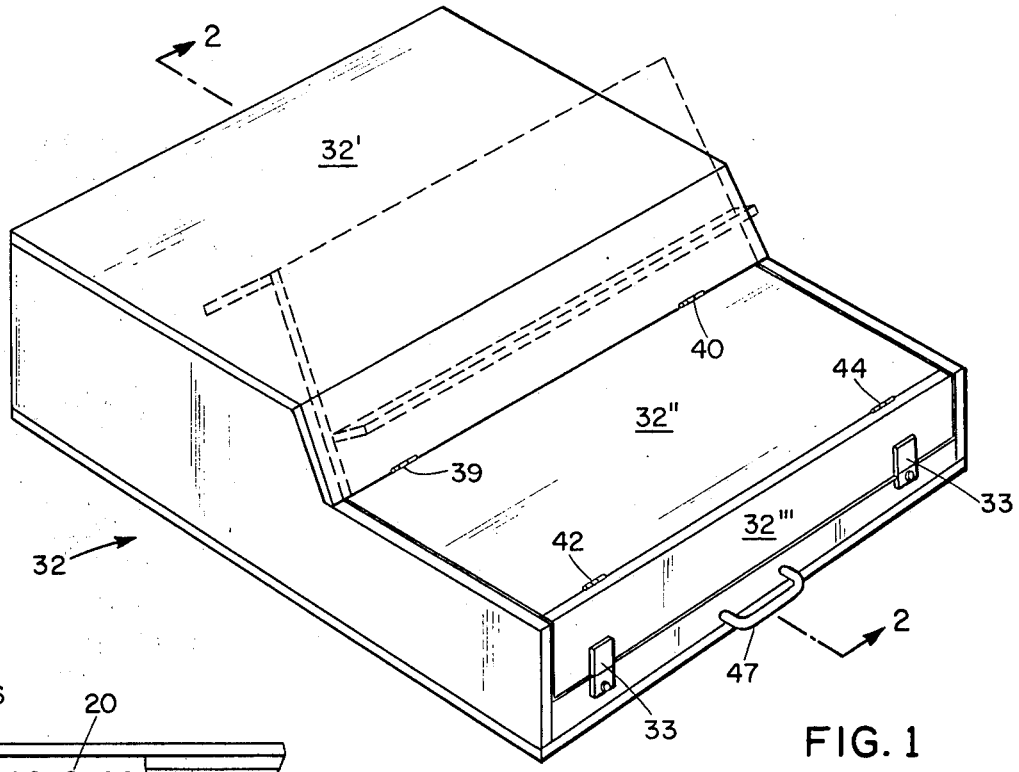
FIG. 1 is a perspective view of the encased instrument.
Figure 3:
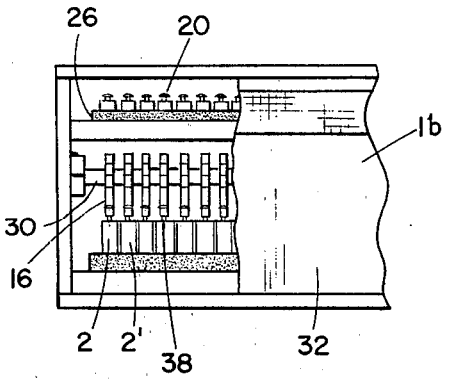
FIG. 3 is a fragmentary view in elevation of the rear of the instrument.
Figure 2:
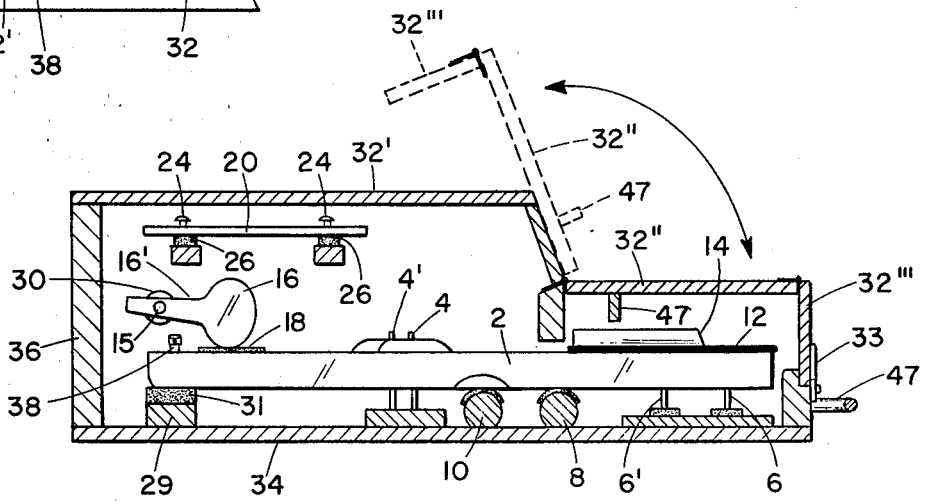
FIG. 2 is a sectional view taken on line 2—2 of FIG. 1.

When the instrument is being readied for playing, the portion 32''' of the cover is disengaged from the front fixed portion of the cover by releasing the latch 33. The portion 32'' and the portion 32''' will fold upwardly about their respective hinges as shown in dotted lines in FIG. 2 which also exposes the keys 12 and 14.

The cover is also provided with a convenient handle 47 for carrying the instrument.

While the instrument has been shown and described in a particular form, it is not intended as a limitation as the scope of the invention is best defined in the appended claims.

I claim:

1. A piano type musical instrument comprising a frame, a plurality of individual operatable key bars mounted on said frame in a side-by-side relationship having one end of each of the said key bars extending over an open keyboard area, the portion of the key bars extending over the key board area having means on the upper surface of each key bar for presenting one of two separate colors, the key bars presenting one color extending further over the key board than the other side key bars presenting another color said key bars presenting the second color being selectively spaced in between the key bars presenting the first mentioned color, a single pivot mounted laterally of the frame about which one set of colored bars is pivoted and a second single pivot extending laterally of the frame and in substantially the same horizontal plane with the first mentioned pivot, about which the second set of color key bars is pivoted, the opposite ends of all the key bars being positioned in a single vertical plane, a single selected sound producing element positioned above the opposite end of each of the key bars, a pivoted hammer positioned below each sound producing element and in a horizontal plane extending between the sound producing element and the outer end of the key bars, means on the opposite end of the key bars adjacent the hammer for moving the said hammer in a vertical plane in contact with the same sound producing element, a stop for receiving the opposite end of the key bar members when the said bars are at rest and means for retaining the key bars substantially perpendicular with the horizontal plane of the key board.

2. In a musical instrument as claimed in claim 1 wherein the pivot for the key bars being of one color is of a greater distance from the opposite end of the key bars than the pivot means for the other color keys.

3. In a musical instrument as claimed in claim 1 wherein the means carried by the key bars for engaging the hammer is adjustable.

4. In a musical instrument as claimed in claim 1 wherein the hammer when in normal position rests on the opposite end of the key bars.

5. In a musical instrument as claimed in claim 1 wherein the instrument is provided with a cover having the portion enclosing the upper side of the keyboard hingedly supported to the remainder of the top portion of the cover to form a musical rack when rotated about the said hinged members attached to the remainder of the cover.

* * * * *